United States Patent [19]

Apel et al.

[11] Patent Number: 4,743,407

[45] Date of Patent: May 10, 1988

[54] EXTERNALLY PRESSURIZED POROUS CYLINDER FOR MULTIPLE SURFACE AEROSOL GENERATION AND METHOD OF GENERATION

[75] Inventors: Charles T. Apel; Lawrence R. Layman; David L. Gallimore, all of Los Alamos, N. Mex.

[73] Assignee: The United States of America as represented by the United States Department of Energy, Washington, D.C.

[21] Appl. No.: 933,439

[22] Filed: Nov. 21, 1986

[51] Int. Cl.[4] ..... B01F 3/04

[52] U.S. Cl. ..... 261/99; 239/338; 239/8; 239/426; 239/434; 261/DIG. 65

[58] Field of Search ..... 239/338, 8, 426, 434; 261/99, DIG. 65

[56] References Cited

U.S. PATENT DOCUMENTS

| | | | |
|---|---|---|---|
| 3,251,556 | 5/1966 | Burnham | 239/338 |
| 3,378,238 | 4/1968 | Babington et al. | 261/30 |
| 3,421,699 | 1/1969 | Babington et al. | 239/434 |
| 3,823,872 | 7/1974 | Frenzl | 239/8 |
| 3,864,326 | 2/1975 | Babington | 239/338 |
| 4,072,209 | 3/1977 | McDowell | 261/99 |
| 4,228,795 | 10/1980 | Babington | 239/338 |
| 4,263,907 | 4/1981 | Lindsey | 239/338 |

FOREIGN PATENT DOCUMENTS

| | | | |
|---|---|---|---|
| 1312057 | 11/1962 | France | 239/338 |

OTHER PUBLICATIONS

Charles T. Apel et al., "Investigations of the Inductively Coupled Plasma Source for Analyzing NURE Water Samples at the Los Alamos Scientific Laboratory," Los Alamos Scientific Laboratory Report, LA-6751-MS (Mar. 1977).

*Primary Examiner*—Tim Miles

*Attorney, Agent, or Firm*—David K. Cornwell; Paul D. Gaetjens; Judson R. Hightower

[57] ABSTRACT

A nebulizer for generating aerosol having small droplet sizes and high efficiency at low sample introduction rates. The nebulizer has a cylindrical gas permeable active surface. A sleeve is disposed around the cylinder and gas is provided from the sleeve to the interior of the cylinder formed by the active surface. In operation, a liquid is provided to the inside of the gas permeable surface. The gas contacts the wetted surface and forms small bubbles which burst to form an aerosol. Those bubbles which are large are carried by momentum to another part of the cylinder where they are renebulized. This process continues until the entire sample is nebulized into aerosol sized droplets.

13 Claims, 2 Drawing Sheets

EXTERNALLY PRESSURIZED POROUS CYLINDER FOR MULTIPLE SURFACE AEROSOL GENERATION AND METHOD OF GENERATION

BACKGROUND OF THE INVENTION

The present invention relates generally to a method and apparatus for producing aerosol sized droplets. This invention is the result of a contract with the Department of Energy (Contract No. W-7405-ENG-36.

A nebulizer is a device which generates an aerosol and disperses the aerosol droplets into a gaseous medium. In order to be considered an aerosol sized droplet, the droplet must remain suspended by Brownian movement or collision with the molecules of a carrier gas. The efficiency of a nebulizer is defined by the percentage of the starting liquid which is converted to aerosol sized droplets. One difficulty with conventional pneumatic aerosol generators is that they are not efficient.

Nebulizers are used for a variety of industry applications including many medical applications and for introduction of a sample into a plasma. In addition, nebulizers have been proposed for carburetion in the automobile industry. By nebulizing gasoline, the fuel could be transported in a condensed phase from the carburetor to the combustion cylinders making automobiles more efficient, particularly in cold weather and over short distances.

There are a number of different type of nebulizers which are currently being used in the various applications mentioned above.

(a) Cross flow pneumatic nebulizer.

In a cross flow nebulizer, a liquid sample is supplied through a tube at a right angle to a high velocity gas jet, typically argon. A resulting aerosol is blown into a spray chamber for use in such applications as sample introduction into an inductively coupled plasma. This type of nebulizer has a number of serious disadvantages. A particle size distribution plot reveals that only 5% of the drops yielded by the cross flow nebulizer are small enough to be considered an aerosol. This yield can be improved by increasing the energy into the system as kinetic energy which is induced by increasing the velocity of the carrier gas.

A second disadvantage of the cross flow nebulizer is that it rapidly consumes the sample. In situations where the sample is limited, a cross flow nebulizer can not be used.

(b) Threaded cross flow nebulizer.

A variation of the cross flow type nebulizer is a threaded cross flow nebulizer which utilizes a threaded chamber at the gas/sample intersection. The motivation for adding the threaded configuration was for ease of adjustment. It was discovered, however, that the surface effects of the spray over a threaded surface helped to increase the efficiency to about 20%. Even with this improvement, this type of nebulizer is far less efficient than desired.

(c) Babington-type nebulizer.

The Babington-type nebulizer flows water with a high surface tension, as a thin film, over the surface of a sphere. A gas is aspirated through a single hole in the sphere to shear off small droplets of liquid, thereby forming an aerosol. The hole in the Babington nebulizer is never completely covered by a film of liquid because, as the liquid begins to enter the area defining the hole, it is sheared to form an aerosol. The high efficiencies reported by Babington-type nebulizers are only achievable by recycling the liquid which drains down the side of the sphere. An example of Babington-type nebulizers can be found in U.S. Pat. No. 4,228,795.

The major drawback in using this type of nebulizer for spectroscopic applications is that there appear to be high memory effects. Memory effects occur when the residual sample from one experiment remains in the apparatus to effect the results of subsequent experiments.

A second problem with the Babington type nebulizer is that a minimum flow rate is needed to form the film flows on the surface of the sphere. In addition, the Babington nebulizer needs a larger sample than needed by the present invention. The reason for this is that the Babington nebulizer is, absent its recycling feature, inefficient.

(d) Ultrasonic nebulizer.

The concept underlying ultrasonic nebulizing of liquids is simple. When ultrasonic energy is supplied to a liquid, capillary waves are generated. If enough ultrasonic energy is applied the waves rupture at the liquid surface to form aerosol-sized droplets. One difficulty with the ultrasonic nebulizer is that it has a tendency to generate aerosol in a cyclic manner. That is, cavitation develops between the surface having the ultrasonic input and the liquid. When this happens, energy is not being transferred to the liquid.

(e) Fritted or porous disk nebulizers.

A fritted or porous disk utilizes a surface which is both wettable and porous. L. Layman et al., "Glass Frit Nebulizer for Atomic Spectrometry", Anal. Chem. 54, 638 (1982) describes the glass frit nebulizer and compares it with the Babington nebulizer. Nebulizing gas is passed through the disk and the liquid on the fritted surface is generated into an aerosol. The gas velocity is low because of the high impedance of the disk. The fritted disk has a narrow droplet size distribution with most droplets being less than 0.5 $\mu$m whereas the Babington-type nebulizer has a much broader droplet size distribution; most of the droplets generated by the Babington-type nebulizer are greater than 3 $\mu$m. High efficiencies can be obtained by introducing the sample at a predetermined location on the fritted surface.

One of the advantages of the subject invention, as discussed in detail below, is the flexibility in the introduction of the sample to an active surface. Although the fritted disk as described in the Laymen et al. article obtains high efficiencies particularly at low rates of sample introduction, there is a need for a nebulizer which has even higher efficiencies and which is efficient at higher flow rates. The fritted disk nebulizer must be oriented in a fixed position in order to obtain high efficiencies.

Accordingly, it is an object of the present invention to provide an apparatus and method for nebulizing liquids efficiently.

It is another object of the invention to provide a nebulizer the orientation of which is not critical to its operation.

It is yet another object of the invention to provide a nebulizer which is efficient over a wide range of rates of sample introduction.

Additional objects and advantages of the invention will be set forth in part in the description that follows, and in part will become apparent to persons of ordinary skill in the art upon examination of the following or may be learned by practice of the invention.

SUMMARY OF THE INVENTION

To achieve the foregoing and other objects and in accordance with the purposes of the present invention as embodied and broadly described herein, the nebulizer of the present invention has first and second gas permeable members having surfaces which are oriented in an opposed configuration. The surface of the first gas permeable member is wet with a liquid to be nebulized on the side of the member opposing the second gas permeable member. A gas is then provided through the first gas permeable member in the direction towards the second gas permeable member. The pressure of the gas is chosen so that small bubbles form at the first surface when the gas intitially makes contact with the liquid. The bubbles expand and then burst forming droplets. Those droplets which are aerosol sized are carried by an effluent gas to a predetermined location. Drops which are not aerosol sized are carried by momentum to wet the surface of the second gas permeable member. Gas is provided through the second gas permeable member in a direction towards the first member and droplets are formed in the same way as they were on the surface of the first gas permeable member. Again, those droplets which are too large to be carried by the effluent gas are returned to the first surface. The process continues until all the liquid is nebulized.

The apparatus of the current invention includes two gas permeable members with opposing surfaces, a means for introducing a liquid to one of the surfaces and means for providing a gas through the gas permeable members.

Another aspect of the invention is that the first and second gas permeable members can be a single member oriented to have opposing surfaces such as a hollow cylinder. In this way a single sleeve can be used around the entire member, allowing a single source to provide gas through the cylinder.

The method of the current invention is to first wet a porous surface with a liquid to be nebulized. The next step is to provide gas through the porous surface in a direction perpendicular to the surface at a sufficient pressure to form bubbles. The pressure is continued until the bubbles burst, forming aerosol sized droplets. Droplets which are too large to be an aerosol are used to wet a second porous surface. Gas is provided through the second porous surface to generate aerosol sized droplets in the same way that the aerosol sized droplets were generated from the first porous surface.

One advantage of the present invention is higher aerosol conversion efficiencies than those measured in the original fritted disk concept at both low frequencies and higher frequencies.

Another advantage of the invention is that orientation of the invention relative to the liquid sample is not critical.

Also, because there is an active surface which allows large droplets to be nebulized, it is not critical that an aerosol be generated with 100% efficiency the first time that gas bursts bubbles on the active surface.

BRIEF DESCRIPTION OF THE DRAWINGS

The accompanying drawings, which are incorporated in and form part of the specification, illustrate one embodiment of the present invention and, together with the description, serve to explain the principles of the invention. In the drawings.

DETAILED DESCRIPTION OF THE PREFERRED EMBODIMENT

Figure 1:
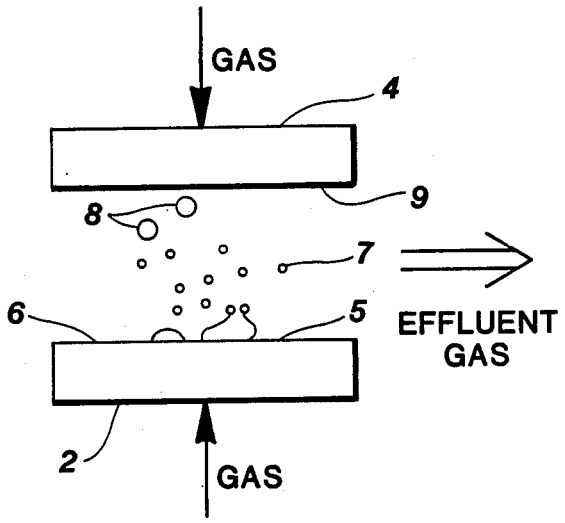
FIG. 1 is a schematic illustrating the concept of the invention.

FIG. 1, a general schematic of the invention, shows first gas permeable member 2 and second gas permeable member 4 in an opposing configuration. The interior surface 5 of first gas permeable member 2 is wet with a liquid 6 shown as a thin film on surface 5. As pressurized gas flows through first gas permeable member 2 in the direction indicated in FIG. 1 bubbles form on its surface 5. The bubbles burst to form aerosol sized droplets 7 and droplets 8 which are too large to be considered an aerosol. The aerosol droplets 7 are carried by effluent gas to a predetermined location. Normally the gas used to form the bubbles is also used as an effluent gas to carry the aerosol to a desired location. Large droplets 8 are carried by momentum to the interior surface 9 of the second permeable member 4 thereby wetting surface 9. As with first gas permeable member 2, gas flows through the second gas permeable member 4 to form droplets. Again, the aerosol sized droplets 7 will be carried out by effluent gas and larger droplets 8 will return by momentum to surface 5. This iteration will continue until all the liquid 6 has been nebulizied into aerosol sized droplets.

Figure 3:
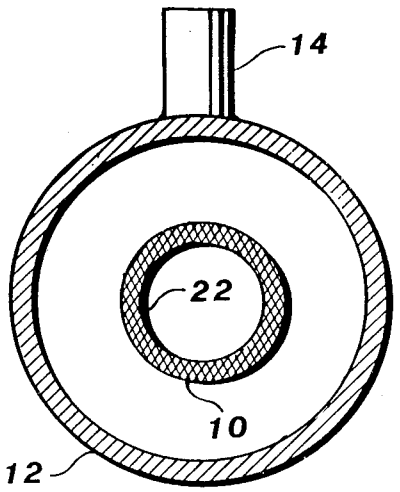
FIG. 3 is an end cross-sectional view of the nebulizer of the present invention taken along line 3—3 of FIG. 2.
Figure 2:
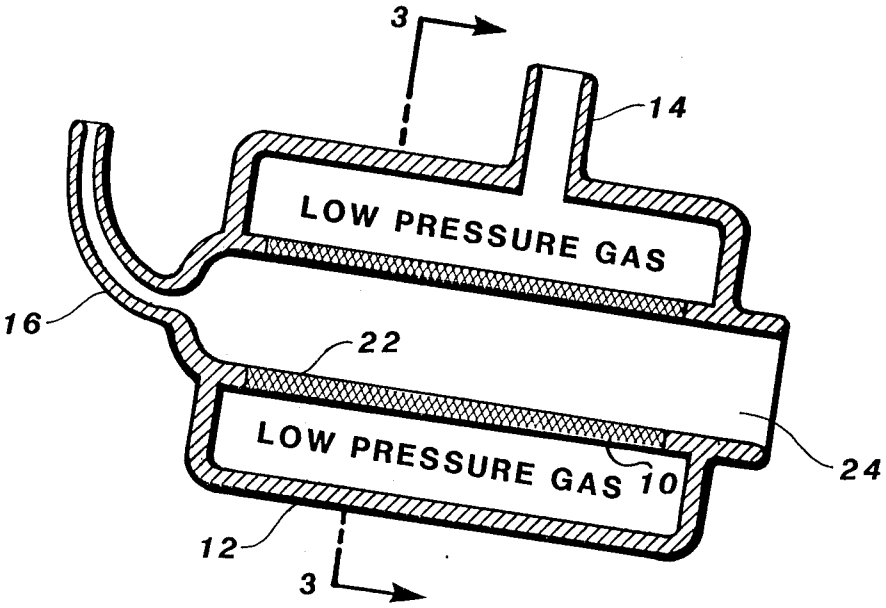
FIG. 2 is a cross-sectional view of one embodiment of the nebulizer of the present invention.

One embodiment of the present invention, illustrated in FIGS. 2 and 3, generally includes a porous cylinder 10 which defines the active volume used to nebulize a liquid. In this embodiment the first and second gas permeable members are a single member having every point on the inside surface of the cylinder having an opposing point. First and second members are, therefore, defined as either distinct members or portions of a single member which have opposing surfaces. Surrounding cylinder 10 is sleeve 12 which encloses a volume of gas used to facilitate the nebulizing of the liquid.

In a preferred embodiment of the invention, porous cylinder 10 is made of fritted glass. It will, however, be recognized that any material which is both gas permeable and wettable by the liquid to be nebulized can be used. The pore size must be small enough to prevent liquid from flowing through the gas permeable material and large enough to allow gas to move through the material. Various applications of the invention may impose additional requirements; for example, a porous cylinder which is resistant to harsh liquid materials. As long as the cylinder satisfies the criteria set forth above, it can be used with the invention.

Disposed around and coaxially with the porous cylinder 10 is sleeve 12 which defines a closed volume. Gas is provided within the closed volume and is forced through gas permeable cylinder wall 10 and into the interior of the cylinder. Gas volume sleeve 12 is typically made of glass and includes gas inlet 14 to introduce within the sleeve 12 a working gas such as argon. Although different applications of the invention require different conditions, in general the gas within the sleeve is provided at relatively low pressures. Because the sleeve 12 defines a closed volume, the only path for the gas to travel is by diffusion through the porous or fritted glass cylinder 10.

At one end of cylinder 10 a liquid inlet 16 is provided which allows the liquid to be nebulized to wet at least a portion of the porous surface 22. The cylinder 10 can be tilted to allow the liquid to wet the entire length of the inside surface of the porous cylinder, enhancing the effectiveness of the nebulizer. At least one end of the gas permeable cylinder 10 is open to allow an aerosol formed within the cylinder to be carried out by effluent gas out of the cylinder and to a location where it can be utilized.

In operation, the low pressure gas passes through the porous surface and passes perpendicular to the wetted surface film. Because the impedance through the fritted glass or porous cylinder is high, the velocity of the gas at the time it contacts the wetted surface is low. It is believed that small bubbles are formed when the low pressure gas contacts and deforms the liquid on the wetted surface 22. The bubbles expand and eventually burst to form small aerosol sized droplets which are carried out the open end 24 of the porous cylinder.

The droplets which are suspended by Brownian movement or collision with molecules of the carrier gas are carried by effluent gas to a predetermined location. The effluent gas may be the gas which flowed through the cylinder 10. The larger droplets, those which are not suspended, are carried by their higher momentum to another portion of the cylinder. They wet that portion of the cylinder and are given another chance to nebulize. This can occur because the entire cylinder is active.

Unlike a Babington type aerosol generator, the fritted surface can operate in any orientation including upside down. This enables a number of active surfaces to be employed. In the preferred embodiment, a cylindrical active surface is used, however it is contemplated that distinct active surfaces could be used in the invention similar to the schematic shown in FIG. 1.

Similarly, the active surface could be a number of different geometries such as thimble shaped or spherical with an opening to allow the resulting aerosol to be used in a particular application.

The invention allows extremely low flow rates of sample over the active surface with close to 100% efficiency. Demonstration of the invention yielded an efficiency of effectively 100% at flow rates as low as 0.05 cc/minute. The pressure of the gas in sleeve 12 was less than 15 psi. This allows conservation of the sample. As the flow rate increases, the efficiency actually decreases, however at all flow rates the efficiency is greater than the fritted disk described in the prior art. The efficiency is attributable to the multiple contact surfaces.

The foregoing description of the embodiments of the invention have been presented for purposes of illustration and description. It is not intended to be exhaustive or to limit the invention to the precise forms disclosed. For example, although the embodiment illustrated is cylindrical shaped, the active surface can be shaped in any way which allows those droplets generated which are too large to be an aerosol to be carried to a second active surface for a second chance to be nebulized. Also, the first and second active surfaces can either form a single monolithic body or be distinct surfaces. Although fritted glass is described as a preferred material to use to form the porous surface, any material can be used. Fritted glass was chosen because it is wettable by most fluids and has a great number of avenues for the gas to flow therethrough.

The embodiments and uses of the invention were chosen and described in order to best explain the principles of the invention and its practical application to thereby enable others skilled in the art to best utilize the invention in various embodiments and with various modifications as are suited to the particular use contemplated. Naturally, the invention can take many forms and is not merely the use of a cylinder in place of a disk, but, rather, the use of a plurality of active surfaces which allows nebulizing of a liquid as well as means for catching and immediately nebulizing those droplets which were not nebulized by the first surface. The cylindrical fritted glass surface allows the liquid multiple chances to nebulize without the need for recirculation methods. It is intended that the scope of the invention be defined by the claims appended hereto.

What is claimed is:

1. A device for generating an aerosol, comprising in combination:

a. a gas permeable cylinder having an open end and a sustantially closed end;

b. means for introducing a liquid into at least a portion of said gas permeable cylinder; and c. a sleeve disposed substantially around said cylinder defining a volume for containing a low pressure gas, whereby the gas is forced through the gas permeable cylinder making contact with the liquid and forming small bubbles which burst to aerosolize the liquid.

2. The device as described in claim 1, further comprising means for introducing a gas into the volume defined by said sleeve.

3. The device as defined in claim 2, whereas said gas permeable cylinder comprises a porous surface which is wettable by the liquid.

4. The device as defined in claim 3, whereas said gas permeable cylinder comprises fritted glass.

5. A device for generating an aerosol, comprising in combination:

a. a first gas permeable active member having a porous surface capable of being wet by a liquid;

b. means for introducing said liquid onto said porous surface;

c. means for providing a gas through said porous surface in a direction substantially perpendicular to said porous surface and at a sufficient pressure to form bubbles at said porous surface which rupture to form aerosol sized droplets and larger sized droplets of said liquid;

d. a second gas permeable active member having a porous surface disposed opposite said porous surface of said first gas permeable active member, said larger sized droplets being carried by momentum to wet said porous surface of said second gas permeable active member; and e. means for providing a gas through said porous surface of said second gas permeable member in a direction substantially perpendicular to said porous surface of said second gas permeable active member and at a sufficient pressure to form bubbles at said porous surface of said second gas permeable active member which rupture to form aerosol sized droplets and larger sized droplets of said liquid.

6. The device for generating an aerosol as described in claim 5, wherein said first and said second gas permeable active members comprise a single cylinder.

7. The device for generating an aerosol as described in claim 5, wherein said porous surfaces comprise a single cylindrical surface.

8. The device for generating an aerosol as described in claim 5, wherein said porous surfaces comprise a single thimble shaped surface.

9. The device for generating an aerosol as described in claim 5, wherein said porous surfaces comprise a single spherical surface.

10. The device for generating an aerosol as described in claim 5, wherein said porous surfaces are fritted glass.

11. A method for generating an aerosol, comprising the steps of:

a. wetting a porous surface with a liquid so that the pores are completely covered with the liquid;

b. providing gas through the porous surface in a direction substantially perpendicular to the surface and at a sufficient pressure to form bubbles at said surface;

c. continuing to provide gas through the porous surface thereby bursting the bubbles and forming aerosol sized droplets and larger sized droplets of said liquid;

d. wetting a second porous surface with said larger sized droplets; and e. providing gas through said second porous surface in a direction perpendicular to said second porous surface and at a sufficient pressure to form bubbles at said second porous surface.

12. The method for generating an aerosol described in claim 11 further comprising:

f. providing an effluent gas to transport said aerosol sized droplets away from said porous surfaces.

13. The method for generating an aerosol described in claim 11 wherein said steps are repeated until substantially all of said liquid is nebulized to aerosol sized droplets.

* * * * *